US008217747B2

(12) United States Patent
Tiemeijer

(10) Patent No.: US 8,217,747 B2
(45) Date of Patent: Jul. 10, 2012

(54) PLANAR INDUCTOR

(75) Inventor: Lukas Frederik Tiemeijer, Eindhoven (NL)

(73) Assignee: NXP B.V., Eindhoven (NL)

( * ) Notice: Subject to any disclaimer, the term of this patent is extended or adjusted under 35 U.S.C. 154(b) by 751 days.

(21) Appl. No.: 11/630,586

(22) PCT Filed: Jun. 17, 2005

(86) PCT No.: PCT/IB2005/052006

§ 371 (c)(1),
(2), (4) Date: Dec. 22, 2006

(87) PCT Pub. No.: WO2006/000973

PCT Pub. Date: Jan. 5, 2006

(65) Prior Publication Data

US 2009/0195343 A1 Aug. 6, 2009

(30) Foreign Application Priority Data

Jun. 23, 2004 (EP) ..... 04102916

(51) Int. Cl.
*H01F 5/00* (2006.01)
*H01F 21/12* (2006.01)
*H01F 27/29* (2006.01)
*H01F 27/28* (2006.01)

(52) U.S. Cl. ..... 336/200; 336/150; 336/192; 336/232

(58) Field of Classification Search ..... 336/150, 336/192, 200, 232
See application file for complete search history.

(56) References Cited

U.S. PATENT DOCUMENTS

| | | | | |
|---|---|---|---|---|
| 3,940,572 | A * | 2/1976 | Burgess | 379/156 |
| 4,816,784 | A * | 3/1989 | Rabjohn | 333/24 R |
| 5,892,425 | A | 4/1999 | Kuhn et al. | |
| 6,480,086 | B1 * | 11/2002 | Kluge et al. | 336/200 |
| 6,608,364 | B2 | 8/2003 | Carpentier | |
| 6,635,949 | B2 | 10/2003 | Lowther et al. | |
| 2001/0033204 | A1 * | 10/2001 | Simburger et al. | 333/24 R |
| 2003/0001709 | A1 * | 1/2003 | Visser | 336/200 |
| 2003/0013134 | A1 | 1/2003 | Roth | |
| 2003/0112114 | A1 * | 6/2003 | Long et al. | 336/200 |
| 2003/0202331 | A1 * | 10/2003 | Jessie et al. | 361/764 |
| 2003/0210122 | A1 | 11/2003 | Concord et al. | |
| 2003/0222750 | A1 * | 12/2003 | Kyriazidou | 336/200 |
| 2004/0061659 | A1 * | 4/2004 | Dunn et al. | 343/788 |
| 2004/0085175 | A1 * | 5/2004 | Lowther | 336/200 |
| 2004/0100349 | A1 * | 5/2004 | Mheen et al. | 336/223 |
| 2004/0108927 | A1 | 6/2004 | Castaneda et al. | |
| 2004/0108935 | A1 | 6/2004 | Kyriazidou | |

FOREIGN PATENT DOCUMENTS

| | | | |
|---|---|---|---|
| EP | 324240 | A2 * | 7/1989 |
| WO | WO 03/015110 | | 2/2003 |

* cited by examiner

*Primary Examiner* — Mohamad Musleh
*Assistant Examiner* — Tsz Chan

(57) ABSTRACT

A planar inductor (50) comprises a conductive path in the form of a spiral pattern (53A-53D, 54A-54D). A conductive connecting path (62A, 63) connects a terminal (60) to an intermediate tap point (61A). The connecting path comprises at least one path portion which is radially directed with respect to the spiral pattern (53A-53D). The connecting path (62A, 63) can be routed via the inside of the spiral pattern. Where the connecting path comprises only radially-directed path portions, they are commonly joined at the center (64) of the spiral pattern. Multiple path portions (62A, 62B) can each connect to the intermediate tap point of a respective conductive path. The connecting path can use a further conductive track (85) which is parallel to the conductive path which forms the spiral pattern.

17 Claims, 4 Drawing Sheets

PLANAR INDUCTOR

This invention relates to planar inductors and methods of manufacture of the same as well as their use in semiconductor devices such as integrated circuits.

Planar inductors are frequently used where an inductor is required which occupies minimal space. Typically, a planar inductor comprises a conductive track, in the form of a spiral pattern, which is laid on a substrate. Connections are made to each end of the spiral track. Planar inductors can be realized as discrete elements using thin-film technologies, or as integrated components using integrated circuit (IC) manufacturing processes. Planar inductors are often used in radio frequency (RF) circuitry to achieve functions such as voltage controlled oscillators (VCOs) and low noise amplifiers (LNAs).

There is a requirement, in some applications, to make a further electrical connection to an intermediate point of the conductive track. This can be a mid-point. FIGS. 1 and 2 show two types of planar inductor and the position of a mid-point. Firstly, FIG. 1 shows a planar inductor with concentric track segments 11A, 11B, 11C. A spiral path is formed between end terminals 10, 12 by interconnecting ends of the segments. The mid-point, in terms of distance and resistance, of the total path between the end terminals 10, 12 is shown by cross 15.

FIG. 2 shows a planar inductor with semi-circular track segments which are interconnected in a symmetrical configuration. A spiral path is formed between end terminals 20, 22 by interconnecting pairs of segments. The mid-point, in terms of distance and resistance, of the total path between the end terminals 20, 22 is shown by cross 25. The disadvantage of such a configuration, however, is that voltage differences between neighbouring winding segments (e.g. segments 26, 27) is generally larger than in case of the spiral configuration shown in FIG. 1 and hence more energy will we stored in the capacitance that exists between the winding segments. This leads to a lower resonant frequency of the coil.

It is desirable for a planar inductor to have a high quality (Q) factor. However, the quality factor can be degraded by current crowding, resulting from the preference of the RF current to take the path of least inductance instead of that of least resistance at elevated frequency. This current crowding is caused by the "skin" and "proximity" effects and results in a significant increase in the resistance seen in series with the inductor. In order to reduce this current crowding it has been proposed to divide the spiral inductor into several current paths which are electrically in parallel with one another, each path having an identical resistance and inductance. WO 03/015110 describes a planar inductor of this type. FIGS. 3 and 4 show two possible ways of providing a pair of parallel paths. When a high Q factor and resonant frequency are required the arrangement of FIG. 3 is preferred. However, when a connection to an intermediate point is required, this can disturb the balance of currents flowing in each of the parallel paths, and can nullify any benefits in the Q factor that such a layout provides.

The present invention seeks to provide a further type of connection to an intermediate point of a planar inductor.

A first aspect of the present invention provides a planar inductor comprising:

a conductive path in the form of a spiral pattern, and a conductive connecting path which connects a terminal to an intermediate tap point along the conductive path, the connecting path comprising a portion which is radially directed with respect to the spiral pattern.

The provision of a connecting path which is, at least in part, radially directed helps to minimise any disturbance to the current flow in the main conductive path of the inductor.

The connecting path can be routed via the inside of the spiral pattern. The connecting path can comprise only radially-directed path portions, in which case path portions from one or more intermediate tap points are commonly joined at the centre of the spiral pattern. Each path portion connects to the desired intermediate tap point of its respective conductive path.

As an alternative to providing an entirely radial connecting path, the connecting path can comprise an additional section of track which is parallel to the conductive path which forms the spiral pattern. This has an advantage of reducing the length of the connecting path, and thereby reduces the resistance of the connecting path. Where there are a plurality of conductive paths, a separate radially-directed path portion connects an intermediate point on each conductive path with the additional section of track.

Preferably, where an additional section of track is used which is aligned with the spiral pattern, the position of the intermediate point is adjusted to compensate for the effects of current passing along the track.

The intermediate point can be a mid-point or any other desired position along the length of the conductive path.

While the spiral pattern is shown in the accompanying drawings as being a generally circular pattern, it will be appreciated that it can be square, rectangular, elliptical, octagonal or indeed any other shape. Thus, the term 'radially-directed' is to be construed as being directed towards the centre of the pattern, whatever shape it has.

The present invention does not only apply to planar inductors, but it can be applied to planar transformers as well.

Embodiments of the invention will be described with reference to the accompanying drawings in which.

Figure 1:
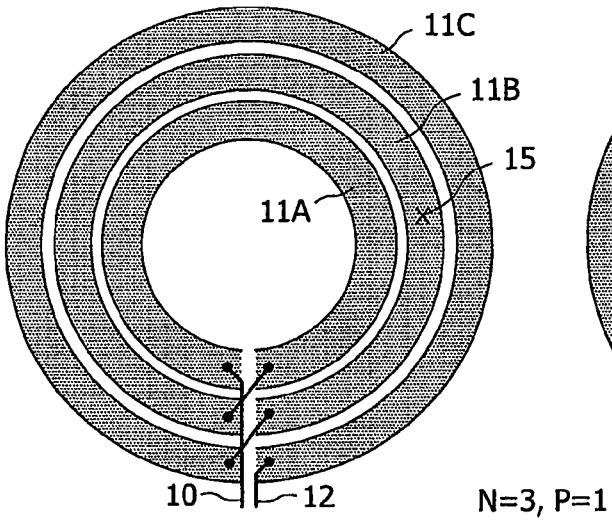
FIGS. 1 and 2 show examples of planar inductors.
Figure 2:
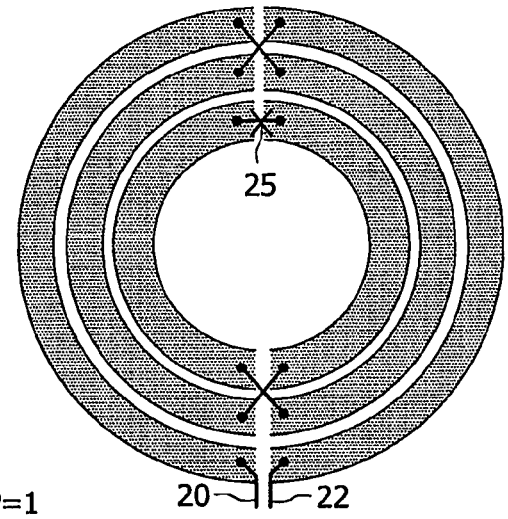
Figure 3:
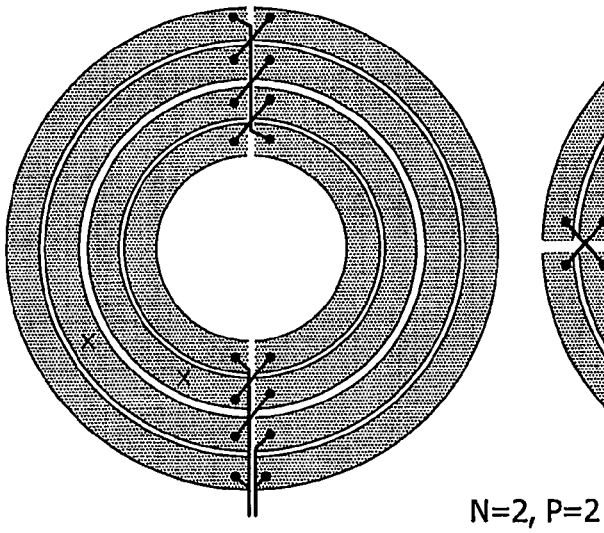
FIGS. 3 and 4 show planar inductors with parallel conductive paths to improve their quality (Q) factor.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

The term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Figure 5:
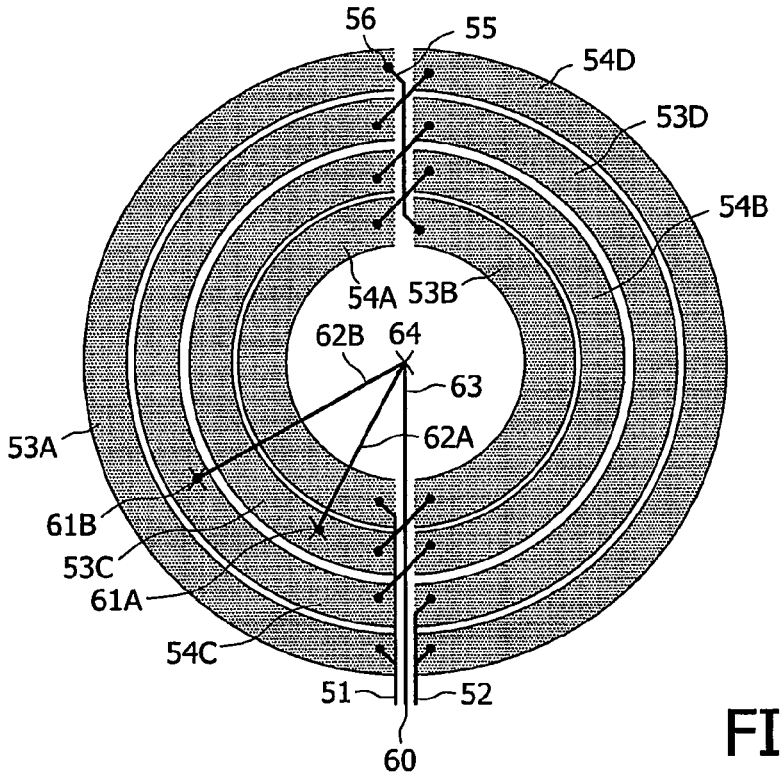
FIG. 5 shows an embodiment of the invention in which a connection is made to an intermediate point of the inductor via a centre point of the spiral pattern.
Figure 6:
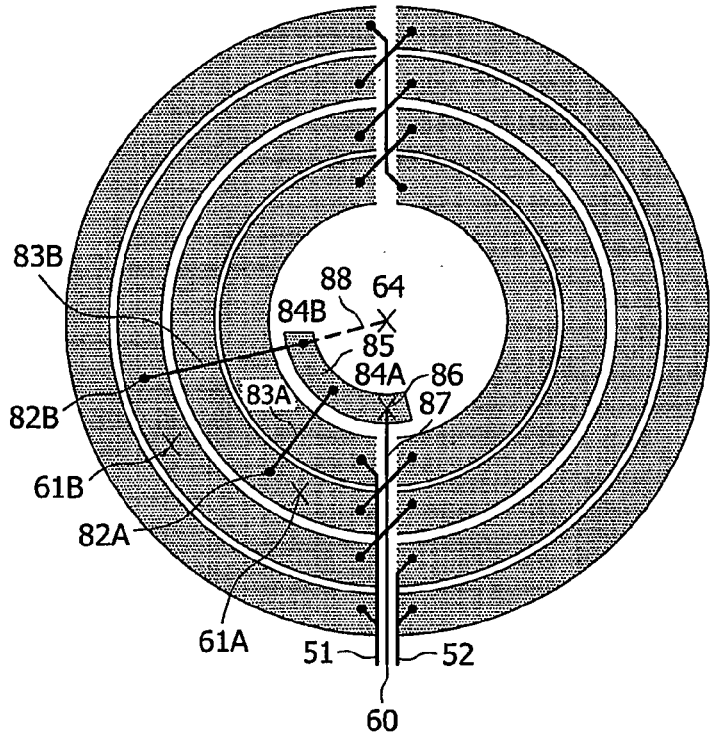
FIG. 6 shows another embodiment of the invention in which a connection is made to an intermediate point of the inductor via a further conductive track within the spiral pattern.

FIGS. 5 and 6 show two embodiments of a planar inductor in accordance with the present invention. The general layout of the planar inductor is the same in both embodiments, the embodiments differing in the manner in which connections are made to intermediate points.

Referring to FIG. 5, the planar inductor 50 comprises four concentric annular rings, each ring being formed as two separate semi-circular segments, e.g. 53A, 54D. The segments can be formed as a layer of conducting material on a substrate using conventional semiconductor manufacturing techniques. A useful description of inductors can be found in the book "Design, Simulation and Applications of Inductors and Transformers for Si RF ICs", A. M. Niknejad, R. G. Meyer, Kluwer Academic, 2000. A first terminal 51 and a second terminal 52 form the two ends of the conductive paths through the inductor. Two paths, which are electrically in parallel with one another, connect the first and second terminals 51, 52, each path taking the form of a generally spiral pattern. The term 'electrically in parallel' has been used to avoid any confusion with the paths needing to be parallel in the sense of being next to each other for their entire path.

Each of the spiral paths comprises a series of the semi-circular segments, with selected pairs of segments being interconnected by links, one of which is shown as 55. Considering one of the parallel paths, this starts at first terminal 51 and includes segments 53A, 53B, 53C and 54D before finishing at terminal 52. Similarly, the second parallel path also starts at terminal 51 and comprises segments 54A, 54B, 54C, 54D before finishing at terminal 52. Links 55 can be realised as short conductive tracks formed on a different layer of the structure, with vias 56 providing a connecting path between the different layers.

The planar inductor can be manufactured from a thick Al layer (having a typical thickness of several microns) which is patterned by etching.

The interconnections between the segments of the inductor can be made by W or Al plugs. Because of the low resistivity of Cu, it is advantageous to use Cu for both for the segments and for the interconnections. Preferably a Cu Damascene process is used. First a groove is formed in the dielectric (e.g. silicon oxide or a low-k material like BCB). A barrier layer is deposited such as TaN. Subsequently a Cu layer is electro plated to a thickness in the range of 500 nm to 5 micron.

The Cu is chemical mechanical polished (CMP), in which the Cu is removed from the planar surface and a Cu pattern in the groove is formed. The Cu pattern in the grooves is the track of the inductor.

In a dual Damascene Cu process, both the tracks as well as the connections (vias) are etched in the dielectric and are subsequently filled with a barrier layer and Cu.

The planar inductor may be manufactured in the back-end of a standard CMOS process or deposited on top of the final product. In a 0.13 μm CMOS process a typical 3 μm thick copper top metal layer pattern is used. From a manufacturing point of view, it is advantageous to use several parallel tracks with a small width. For instance, 8 tiny 3 μm wide tracks suffer much less from CMP dishing (in a Damascene process) than one big 24 μm wide track. A reduced dishing allows lower values for the resistance. The semi-circular track segments are interconnected in a symmetrical configuration. The interconnections comprise a via and a metal track. The resistance is kept as low as possible by using Cu in the via and for the metal track. Preferably the same material having a low resistivity is used in the via and as metal track, so that contact resistances are minimized.

The mid-point of the first spiral path is shown by cross 61A. The mid-point is the point that is exactly mid-way along the total inductance of the first spiral path between terminals 51, 52. Similarly, the mid-point of the second spiral path is shown by cross 61B. This again is the point that is exactly mid-way along the total inductance of the second spiral path between terminals 51, 52.

The mid-point is defined here as the point where the impedance at the intended operating frequency is half of its total value. This point can be approximated by taking the mid-point as the point where the inductance is half of its total value.

A connecting link 62A connects the mid-point 61A of the first spiral pattern to a centre point 64 of the overall inductor pattern. A fer connecting link 62B connects the mid-point 61B of the second spiral path to centre point 64. Each of the connecting links 62A, 62B is directed radially with respect to the overall pattern, i.e. perpendicular to each of the current-carrying semicircular track segments that it crosses. The radial paths 62 are oriented in such a way that the inductive coupling to the spiral inductor is equal to zero.

A further radially directed connecting link 63 extends between centre point 64 and the external terminal 60 from where a connection can be made to other integrated or external components. Conveniently, link 63 is aligned with the gaps that exist between neighbouring semicircular segments and can be formed on the same layer of the structure as the semi-circular segments. A mid-point is required for a differential negative resistance oscillator such as described in fig. 16.31 in the book "The design of CMOS radio frequency integrated circuits" by T. H. Lee, Cambridge University Press 1998.

This arrangement is based on an understanding that connections between points of the inductor experience the influence of the magnetic field of the coil. This magnetic field causes induced voltages which can result in a current that may disturb the normal current distribution over the parallel spiral current paths. This induced voltage only appears in interconnecting paths which are circumferentially directed, i.e. paths which are more or less parallel to the coil windings, and not in radial paths. Thus, the mid-points 61A, 61B are connected to the external terminal 60 only via paths 62A, 62B, 63 that are radially directed.

FIG. 6 shows another planar inductor which has the same general layout as that shown in FIG. 5. The main difference in this embodiment is the manner in which midpoints of the spiral paths are connected to the external terminal.

A further conducting track 85 is laid alongside the innermost annular ring of the inductor. A first connecting link 83A connects a point 82A of the first spiral pattern to a point 84A on the track 85. Link 83A is radially directed with respect to the spiral pattern, i.e. it perpendicularly crosses the current-carrying segments. Similarly, a further connecting link 83B connects a point 82B of the second spiral path to a point 84B on the track 85. For reasons that will be explained below, points 82A, 82B are not the mid-points of their respective spiral paths. A further radially directed connecting link 87 extends between external terminal 60 and a point on track 85 which is radially aligned with the link 87. Conveniently, link 87 is aligned with the gaps that exist between neighbouring semicircular segments. Conducting track 85 only requires a length which is sufficient to join points 84A, 84B and 86 and does not need to be any longer.

In the arrangement shown in FIG. 5 current is first carried from point 61A to the centre point 64 of the inductor via link 62A and then carried from the centre point 64 to the external terminal 60 via link 63. While this has the least disturbing effect on the spiral paths the length of this path incurs additional resistance and hence will incur a voltage drop. In contrast, in the arrangement shown in FIG. 6 the mid-point interconnecting path is shortened by using track 85. It is possible to calculate what effect the passage of current along track 85 will have on the remaining pattern as a function of angle difference and distance to the centre of the coil. By adjusting the angular position of the radial interconnect (i.e. from the true mid-point 61A to point 82A, and from mid-point 61B to 82B) the induced voltage can easily be corrected for. Modern simulation tools can easily calculate the necessary corrections.

Below is an example of such a calculation.

The self and mutual inductances Mij of the inductor loops of the inductor of FIG. 6 are given in the table below. Here an outer diameter of 200 μm, a loop width and spacing of 10 μm and 2.5 μm were assumed.

| Mij | 1 | 2 | 3 | 4 | 5 |
|---|---|---|---|---|---|
| 1 | 4.32E−10 | 2.74E−10 | 2.09E−10 | 1.74E−10 | 1.50E−10 |
| 2 | 2.74E−10 | 5.05E−10 | 3.24E−10 | 2.50E−10 | 2.09E−10 |
| 3 | 2.09E−10 | 3.24E−10 | 5.81E−10 | 3.76E−10 | 2.92E−10 |
| 4 | 1.74E−10 | 2.50E−10 | 3.76E−10 | 6.58E−10 | 4.30E−10 |
| 5 | 1.50E−10 | 2.09E−10 | 2.92E−10 | 4.30E−10 | 7.36E−10 |

The numbering starts at loop segment 85 and ends at the loop 53A-54D. The voltage across each of the loops can now be calculated using:

$$V_i = j\omega\Sigma_{j=1}^{5} M_{ij} I_j \quad (1)$$

where we have neglected the resistance of the loops. We see that the voltage V across each loop is a function of the currents flowing in all loops. Lets assume an RF current with a frequency ω of $10^9$ and an RMS value of 2 Ampere is forced between the inductor contacts 51 and 52 and that this current splits equally between the two electrically parallel paths and the current in the segments 83A, 83B and 85 is zero. We than have $I_1=0$ and $I_2=I_3=I_4=I_5=1$ A. Using equation (1) we find that the RMS values of the voltages induced over the five loops are $V_1=0.80$, $V_2=1.29$, $V_3=1.57$, $V_4=1.71$, and $V_5=1.67$ Volt. These voltages apply to the full 360 degree loop. Adding the voltage across the half loops 2,3,4, and 5 we find that voltage induced between the inductor contacts will be 3.12 Volt. Since the corresponding current is 2 A, we conclude that the inductance seen between contacts 51 and 52 is 1.56 nH for this particular inductor. Similarly we can calculate that the voltage between the connection from 53B to 53C and the contact 51 is 1.48 Volt, and the voltage between the connection from 54B to 54C and the contact 51 is 1.43 Volt. The midpoints 61A and 61B should be located where the voltage is 1.56 Volt. Since the total voltage drop across loop 3=1.57 V it is easily calculated that midpoint 61A is 19 degrees to the left of the connection from 53B to 53C, and since the total voltage drop across loop 4=1.71 V it is easily calculated that midpoint 61B is 27 degrees to the left of the connection from 54B to 54C. We will now calculate the preferred position of the connecting lines 82A-83A-84A and 82B-83B-84B. The desired midpoint voltage at position 86 is 1.56 Volt. The voltages at point 84A and 84B will be: $V_{84A}=1.56+0.80X$ and $V_{84B}=1.56+0.80Y$, where X and Y denote the required angular extends of the loop 85. Similarly the voltages at point 82A and 82B will be: $V_{82A}=1.48+1.57X$ and $V_{82B}=1.43+1.71Y$.

To fulfill the initial assumption made in this calculation that the high frequency currents in the connecting lines 83A and 83B are zero we require $V_{82A}=V_{84A}$ and $V_{82B}=V_{84B}$. Solving this gives X=0.1038 and Y=0.1428, which implies that the connecting lines 83A and 83B need to be located at angles of 37 and 51 degrees to the left of the midpoint connection 60.

Figure 7:
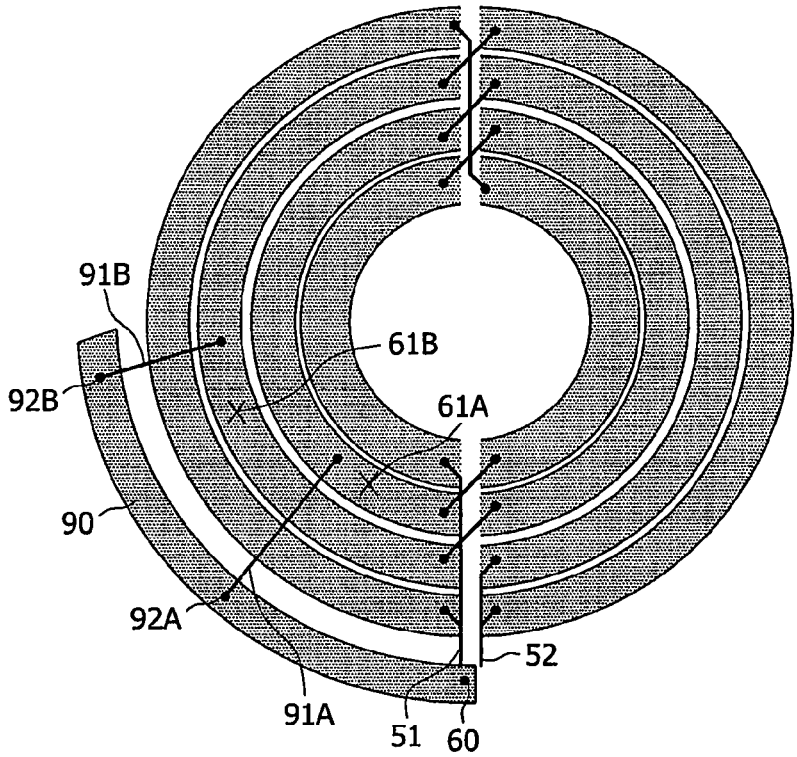
FIG. 7 shows a further embodiment of the invention in which a connection is made to an intermediate point of the inductor via a further conductive track outside the spiral pattern.

In FIG. 6 paths 83A, 83B connect mid-points of the spiral paths with an additional track 85 positioned inside the overall pattern. In an alternative embodiment, shown in FIG. 7, the additional track is positioned outside of the overall pattern. Here, the additional track 90 lies alongside, and is parallel to, the outermost semi-circular segment of the pattern. Radially-directed links 91A, 91B connect to points on the track 90 at points 92A, 92B respectively. A connection can be made at point 60, as shown, or at any other point along track 90.

Figure 4:
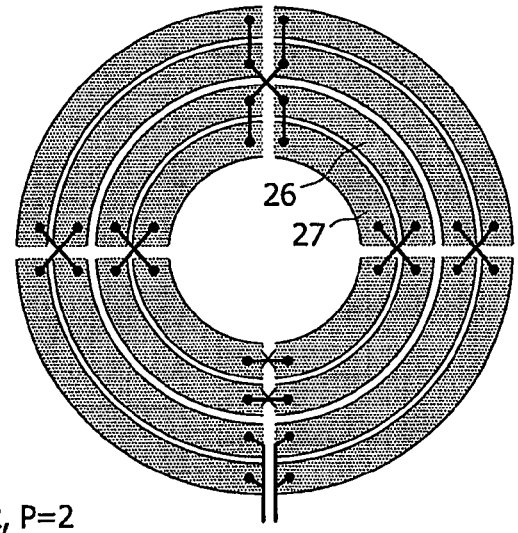

In the above described embodiments connections are made to the mid-points of each spiral path. However, the invention is not limited just to mid-points, but can be applied to connections to any intermediate point along the length of the spiral paths. The spiral pattern is shown here as being formed by semi-circular segments (which together form annular rings), but the overall shape of the segments can be square, rectangular, elliptical, octagonal or indeed any other shape. The segments need not be semi-circular, but may be quadrants, as shown in FIG. 4, or any other shape and the way in which the segments are interconnected to form a spiral path can be varied to suit the particular shape and layout required.

While the radial interconnecting path offers the ideal connection, the interconnecting path can have a direction which is not entirely radial, i.e. it has a significant radial component and a smaller component which is directed parallel to the tracks forming the spiral path. Preferably, where a path which is not entirely radial is used the position of the intermediate point is varied to accommodate any effect.

In the above described embodiments, two parallel paths are shown between the end terminals, with connections being made to intermediate points of both paths. The invention can be applied to any number of parallel paths although, for reasons of maintaining a balance between the parallel paths, it is preferred for the parallel paths to be provided in multiples of two.

Figure 8:
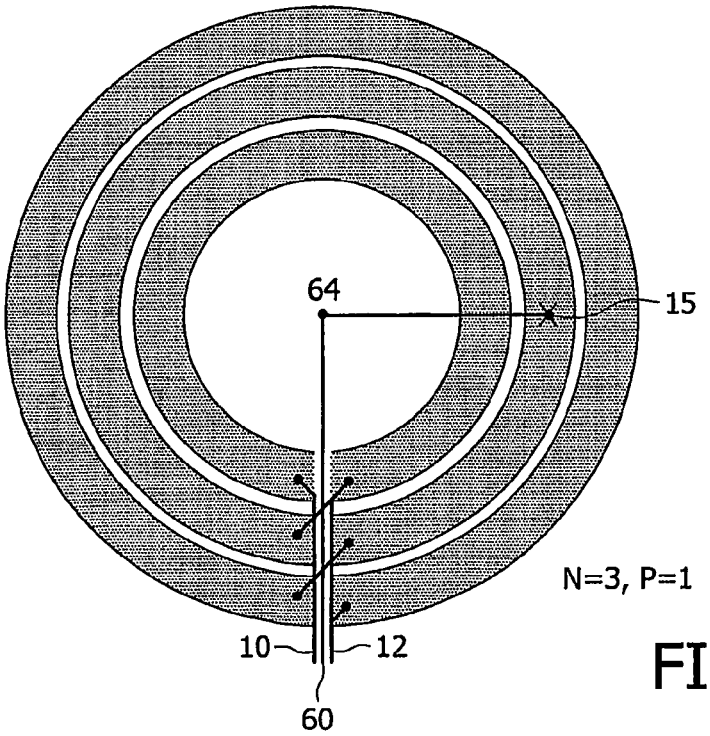
FIG. 8 shows a further embodiment of the invention in which a connection is made to an intermediate point of the inductor via a centre point of the spiral pattern.

Referring back to FIG. 1, the planar inductor has a single conductive path in the form of a spiral with a mid-point 15. It is desirable to route a connecting path between the mid-point 15 and a position adjacent the end terminals 10, 12 so that all connections can be made at a common point. The connecting path to the mid-point can be achieved by two radially directed paths; one between the mid-point 15 and a centre point of the pattern, and another between the centre point and a point between the terminals 10, 12 in the same manner as shown in FIG. 5. The result is shown in FIG. 8. Alternatively, the connecting path to the mid-point can include an arc-shaped track which lies inside (or outside) the segments forming the spiral pattern, and parallel to them, in the same manner as shown in FIG. 6. The position of the mid-point tap will need to be altered to offset for the effects of using this track.

Figure 9:
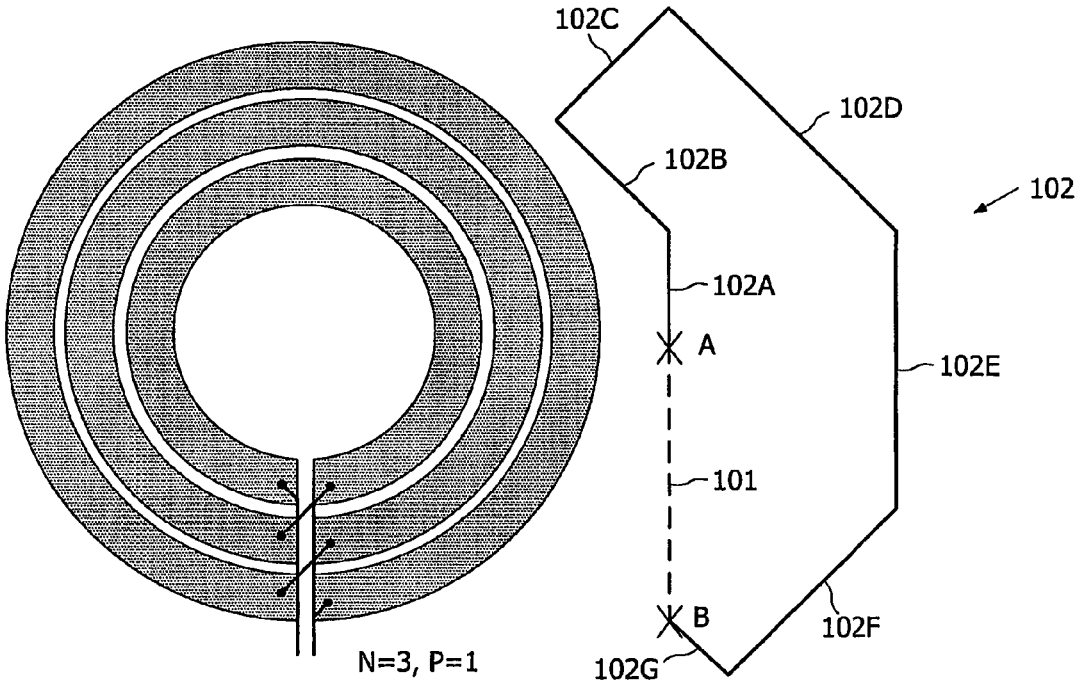
FIG. 9 shows a way of connecting terminals in the vicinity of a planar inductor.

The principles of the present invention can also be applied to all interconnections that are in the vicinity of the inductor, even if the interconnection is not intended for connection to the inductor. FIG. 9 shows an example with A representing a first connecting point, such as the input of a sensitive amplifier, and B representing a second connecting point, such as a connection to a decoupling filter which has to protect the inputs of the amplifier against disturbing high frequency signals. When the connecting path between points A and B is made as short as possible, as shown by path 101, a disturbance voltage may be induced into the path due to the coil. By using a longer path shown as path 102, the induced disturbance is minimised. Path 102 comprises sections 102A-G which are generally either radially directed (sections 102C, 102G) or are directed substantially parallel to the tracks forming the spiral pattern. A curved connecting path may be used in preference to the multiple straight sections shown here.

The invention is not limited to the embodiments described herein, which may be modified or varied without departing from the scope of the invention.

The invention claimed is:

1. A planar inductor comprising:

conductive paths in the form of a spiral pattern, each of the conductive paths being electrically in parallel with one another; and a conductive connecting path which connects a terminal to an intermediate tap point along one of the conductive paths, the conductive connecting path comprising a portion which is radially directed with respect to the spiral pattern, wherein the conductive paths comprise at least three circular segments that are concentric with respect to the center of the spiral pattern, wherein the at least three circular segments include at least three non-overlapping gaps, wherein the at least three non-overlapping gaps are radially aligned with respect to the center of the spiral pattern, and wherein a portion of the conductive connecting path is located within the at least three non-overlapping gaps.

2. The planar inductor according to claim 1 wherein the conductive connecting path comprises a first portion which joins the intermediate tap point to a connecting point which is inside the spiral pattern, the first portion being radially directed with respect to the spiral pattern.

3. The planar inductor according to claim 2 wherein the connecting point is substantially at the centre of the spiral pattern.

4. The planar inductor according to claim 3 wherein there is a separate first portion of the conductive connecting path for each of the conductive paths, each first portion joining a respective intermediate tap point along one of the paths to the connecting point.

5. The planar inductor according to claim 2 wherein the conductive connecting path further comprises a second portion which joins the connecting point within the spiral pattern to a point outside the spiral pattern, the second portion being radially directed with respect to the spiral pattern.

6. The planar inductor according to claim 5, wherein the second portion connects to a point outside the spiral pattern which is adjacent the end points of one of the conductive paths.

7. The planar inductor according to claim 2 wherein the first portion of the conductive connecting path joins the intermediate tap point to a connecting point which is located between the tap point and a centre point of the spiral pattern.

8. The planar inductor according to claim 7 further comprising a further conductive track which is parallel to one of the conductive paths.

9. The planar inductor according to claim 8 wherein there is a first portion of the conductive connecting path for each of the conductive paths, each first portion joining a respective intermediate tap point along one of the conductive paths to a respective connecting point and wherein the conductive track joins the respective connecting points.

10. The planar inductor according to claim 9 wherein the position of the intermediate tap point along each conductive path is chosen to offset an effect of a passage of a current along the further conductive track.

11. The planar inductor according to claim 8 wherein the conductive connecting path further comprises a second portion which joins the further conductive track to a point outside the spiral pattern, the second portion being radially directed with respect to the spiral pattern.

12. An electrical circuit comprising the planar inductor according to claim 1 and at least two further terminals external to the inductor, wherein the further terminals are connected via a connecting path comprising path portions that are radially directed with respect to the spiral pattern of the inductor.

13. The planar inductor of claim 1, wherein the conductive connecting path is perpendicular to each of the conductive paths that the conductive connecting path crosses.

14. A planar inductor comprising:

conductive paths in the form of a spiral pattern, each of the conductive paths being electrically in parallel with one another, wherein the spiral pattern has a circular shape, an elliptical shape, or an octagonal shape; and a conductive connecting path which connects a terminal to an intermediate tap point along one of the conductive paths, the conductive connecting path comprising a portion which is radially directed with respect to the spiral pattern, wherein the conductive paths comprise at least three circular segments that are concentric with respect to the center of the spiral pattern, wherein the at least three circular segments include at least three non-overlapping gaps, wherein the at least three non-overlapping gaps are radially aligned with respect to the center of the spiral pattern, and wherein a portion of the conductive connecting path is located within the at least three non-overlapping gaps.

15. A planar inductor comprising:

conductive paths in the form of a spiral pattern, each of the conductive paths being electrically in parallel with one another; and a conductive connecting path which connects a terminal to an intermediate tap point along one of the conductive paths, the conductive connecting path comprising a portion which is radially directed with respect to the spiral pattern, wherein the conductive paths comprise at least three circular segments that are concentric with respect to the center of the spiral pattern, wherein the at least three circular segments include at least three non-overlapping gaps, wherein the at least three non-overlapping gaps are radially aligned with respect to the spiral pattern, and wherein a portion of the conductive connecting path is located within the at least three non-overlapping gaps.

16. The planar inductor of claim 15, wherein the portion of the conductive connecting path does not completely fill any of the gaps.

17. The planar inductor of claim 15, wherein the concentric segments are interconnected in a symmetrical configuration, wherein interconnections of the concentric segments comprise a via and a metal track, and wherein a same material is used in the via and as metal track.

* * * * *